US008215482B2

(12) United States Patent
Cronin et al.

(10) Patent No.: US 8,215,482 B2
(45) Date of Patent: Jul. 10, 2012

(54) TOBACCO CONTAINER WITH INSERT

(75) Inventors: Edward P. Cronin, Brodhead, WI (US); Joseph P. Valley, III, Roscoe, IL (US); Gregg Hoffman, Rockford, IL (US)

(73) Assignee: J.L. Clark, Inc., Rockford, IL (US)

( * ) Notice: Subject to any disclaimer, the term of this patent is extended or adjusted under 35 U.S.C. 154(b) by 0 days.

(21) Appl. No.: 12/168,244

(22) Filed: Jul. 7, 2008

(65) Prior Publication Data

US 2010/0000888 A1 Jan. 7, 2010

(51) Int. Cl.
*B65D 85/00* (2006.01)

(52) U.S. Cl. ..... 206/236; 206/38; 206/242; 206/265

(58) Field of Classification Search ..... 206/265, 206/236, 38, 242; 220/310.1, 849, 803, 795, 220/304, 345.6, 804, 806, 378, 614, 681, 220/308, 4.27, 4.26, 23.91, 23.87, 780, 799, 220/8

See application file for complete search history.

(56) References Cited

U.S. PATENT DOCUMENTS

| | | | | | |
|---|---|---|---|---|---|
| 411,773 | A | * | 10/1889 | Atkinson | 220/4.24 |
| 660,739 | A | * | 10/1900 | Taylor | 220/377 |
| 902,166 | A | * | 10/1908 | Perlich | 220/23.87 |
| 1,616,381 | A | * | 2/1927 | MacDougall | 132/298 |
| 2,077,219 | A | * | 4/1937 | Conner | 220/4.27 |
| 2,521,278 | A | * | 9/1950 | Bauman | 220/8 |
| 2,551,615 | A | * | 5/1951 | Maher | 220/284 |
| 3,070,275 | A | | 12/1962 | Bostrom | |
| 3,378,020 | A | * | 4/1968 | Grabiel | 206/5.1 |
| 3,687,334 | A | | 8/1972 | McNeil | |
| 3,871,543 | A | | 3/1975 | Chadfield et al. | |
| 4,052,234 | A | | 10/1977 | Yamagishi et al. | |
| 4,098,421 | A | | 7/1978 | Foster | |
| 4,190,170 | A | | 2/1980 | Boyd | |
| 4,442,971 | A | | 4/1984 | Helms | |
| 4,646,933 | A | | 3/1987 | Jurczenia et al. | |
| 4,804,101 | A | * | 2/1989 | Heath | 206/236 |
| 5,184,745 | A | * | 2/1993 | Havens et al. | 220/23.83 |
| 5,794,814 | A | * | 8/1998 | Baerenwald | 220/4.24 |
| D494,474 | S | | 8/2004 | Houk et al. | |
| D499,025 | S | | 11/2004 | Houk et al. | |
| D510,524 | S | | 10/2005 | Houk et al. | |

(Continued)

FOREIGN PATENT DOCUMENTS

EP 0 219 297 A2 4/1987

(Continued)

OTHER PUBLICATIONS

U.S. Appl. No. 29/320,880, Cronin, filed Jul. 7, 2008.

(Continued)

*Primary Examiner* — J. Gregory Pickett
*Assistant Examiner* — Andrew Perreault
(74) *Attorney, Agent, or Firm* — Reinhart Boerner Van Deuren P.C.

(57) ABSTRACT

A tobacco container is provided. The tobacco container includes a lid, a container body and an insert in the form of a liner. The liner releasably connects the lid to the container body. Each of the lid and container body receive and connect to the liner. The liner can include a compression lip that is deformed when the liner is connected to the container body. The liner connects the container body and lid to one another without the two components contacting each other.

26 Claims, 8 Drawing Sheets

U.S. PATENT DOCUMENTS

| | | | | |
|---|---|---|---|---|
| D512,636 | S | 12/2005 | Pace | |
| D513,386 | S | 1/2006 | Pace et al. | |
| D514,936 | S | 2/2006 | Pace et al. | |
| D515,426 | S | 2/2006 | Pace et al. | |
| D515,429 | S | 2/2006 | Pace | |
| D515,439 | S | 2/2006 | Pace | |
| D515,928 | S | 2/2006 | Pace | |
| D523,752 | S | 6/2006 | Bried et al. | |
| D563,786 | S | 3/2008 | Welk et al. | |
| 2007/0095847 | A1 * | 5/2007 | Gruver et al. | 220/780 |
| 2008/0202956 | A1 * | 8/2008 | Welk et al. | 206/265 |

FOREIGN PATENT DOCUMENTS

| | | | |
|---|---|---|---|
| NL | 7 0168 22 | A | 5/1972 |
| WO | WO 01/56411 | A1 | 8/2001 |
| WO | WO 2005/016036 | A1 | 2/2005 |
| WO | WO 2008/066450 | A1 | 6/2008 |

OTHER PUBLICATIONS

U.S. Appl. No. 29/320,885, Cronin, filed Jul. 7, 2008.

U.S. Appl. No. 11/680,333, Welk et al., filed Feb. 28, 2007.

* cited by examiner

TOBACCO CONTAINER WITH INSERT

FIELD OF THE INVENTION

This invention generally relates to containers and more particularly to containers for smokeless tobacco.

BACKGROUND OF THE INVENTION

Loose tobacco and related tobacco products are typically packaged and sold in disc-shaped containers. In many cases, the containers comprise a metal lid seated upon either a metal, plastic or cardboard can. Often, a band-type label is adhesively secured over the seam between the lid and can to securely fasten the lid and the can. The band type label also typically will positively impact the freshness of the product. The label also typically includes print, images, and information regarding the tobacco product for a potential customer.

Conventionally, the lid includes a relatively flat top portion and a surrounding skirt. The skirt terminates in a cut edge. Considering that lids are often formed from metal (plastic lids are also common), a metal edge has the potential to be relatively sharp. If the sharp edges are not properly made smooth, a purchaser of the container may potentially risk suffering a laceration in one of their fingers when prying the lid from the can using the edges. The interface between the can and the lid typically will have a snap fit to facilitate removal and attachment of the lid and the can. The interface between the lid and the can affects breathability and therefore freshness of the tobacco product contained therein. Thus, the interface between the lid and the can may include multiple configurations.

Unfortunately, the use of plastic or cardboard for forming the components of the can make the can look cheap or flimsy. However, forming a can entirely from metal can be difficult to connect the lid to the can and to provide a good repeatable connection between the lid and the can. The present invention is directed towards improvements over the state of the art.

BRIEF SUMMARY OF THE INVENTION

The present invention has several aspects that may be claimed and stand as patentable independently and individually or in combination with other aspects, including but not limited to the following aspects and embodiments.

In embodiment, the invention provides a tobacco container comprising a lid, a container body and a liner. The liner releasably connects the lid to the container body. Each of the lid and container body receive and connect to the liner.

In a preferable implementation, the lid and the container body are formed of metal while the liner is formed of a self-supporting plastic.

In a further preferred implementation, the liner connects the container body and lid to one another without the two components contacting each other.

In yet another embodiment, a liner for a tobacco container is provided that includes a liner body and means for connecting a container lid to the liner and means for connecting a container body to the liner. The liner body includes a closed end wall and an annular sidewall extending from the closed end wall. The means for connecting a container lid to the liner are independent of the means for connecting a container body to the liner.

Other embodiments of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
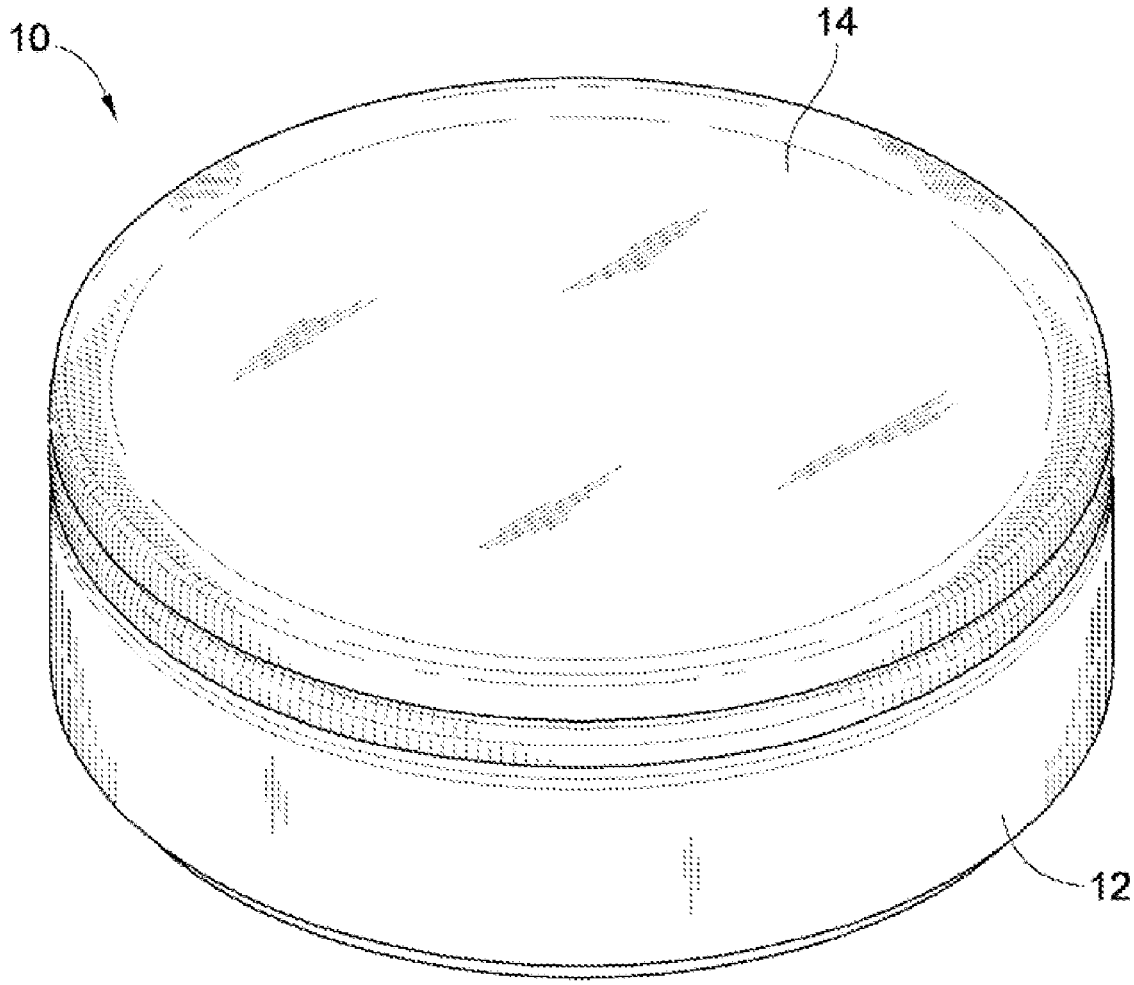
FIG. 1 is a top and front perspective view of an exemplary embodiment of a tobacco can in accordance with the teachings of the present invention.

Referring to FIG. 1, a container 10 is illustrated. The container 10 is typically employed to house chewing tobacco or other goods suitable for retail purchase by a consumer. In that regard, the container 10 has an overall size that allows a consumer to comfortably hold the container within the palm of a hand and to store the container within a shirt pocket or in the rear pocket of a pair of blue jeans. Typically the size for facilitating these tobacco container functions is between about 2 and 3 inches in diameter and between about ¾ inches and 1¼ inches in axial thickness and is most typically approximately 2½ inches in diameter and approximately 1 inch in axial thickness.

The container 10 may include features that make the container more aesthetically pleasing such as, for example, color, images or prints, labels, embossing, and the like. The container 10 may also be secured together by, for example, a band-type adhesive label during a packaging process. After the label has been broken, the container 10 may be repeatedly opened and closed such that the consumer may access, as often as desired, a chosen amount of the contents stored in the container 10.

Figure 2:
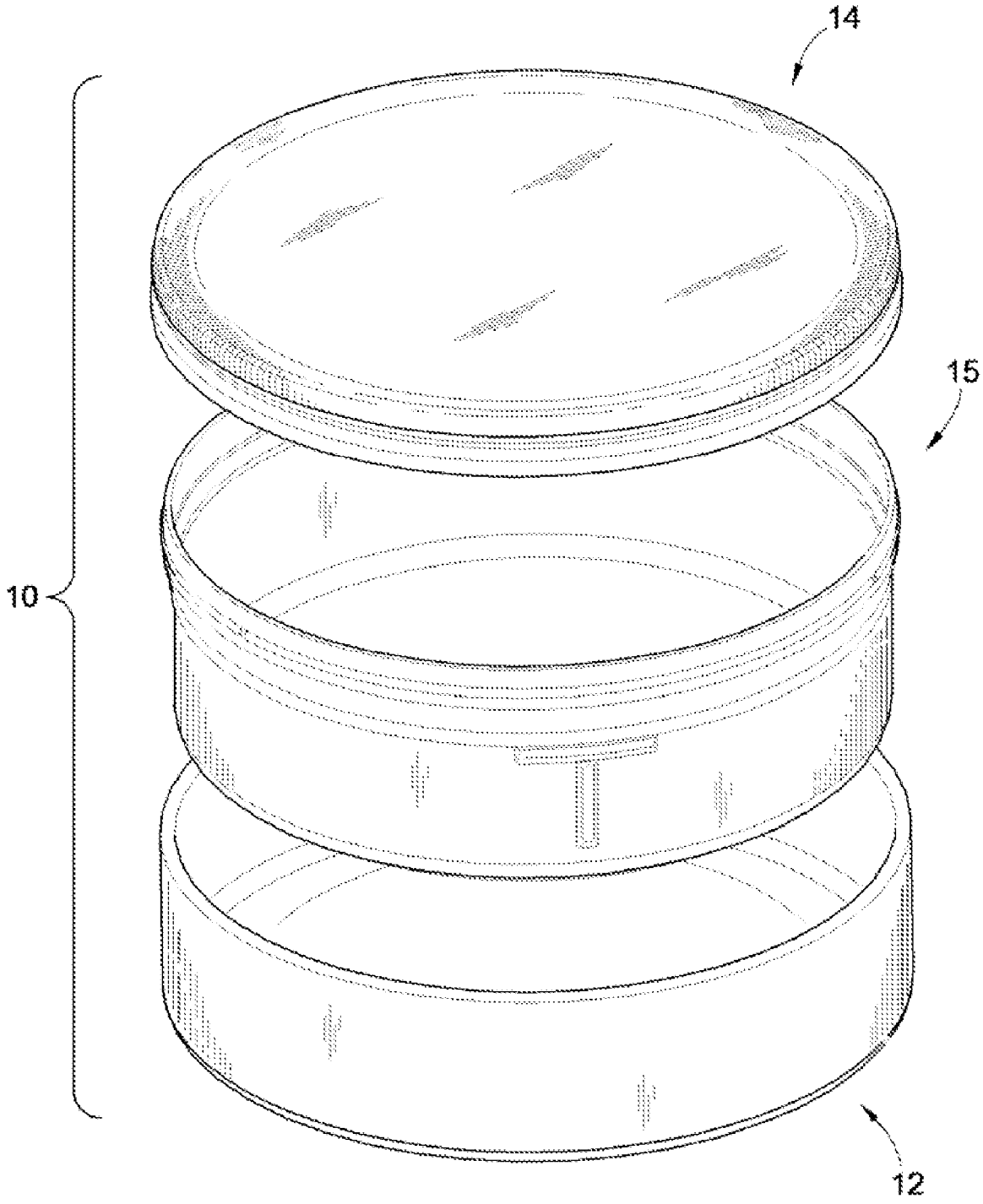
FIG. 2 is an exploded perspective illustration of the tobacco can of FIG. 1.

As shown in FIG. 2, the container 10 includes three components including a generally cylindrical container body 12 (a.k.a., cup or base), a lid 14 (a.k.a., cover) and an insert in the form of a liner 15. The container body 12, lid 14 and liner 15 are suitably formed from a variety of different materials or combinations thereof, such as metal, plastic, cardboard, and the like. In a preferred embodiment, the container body 12 and lid 14 are formed from metal while the liner 15 is formed from a plastic. More preferably, the liner 15 is formed from a sufficiently rigid plastic such as polypropylene such that the liner 15 is self-supporting.

Figure 4:
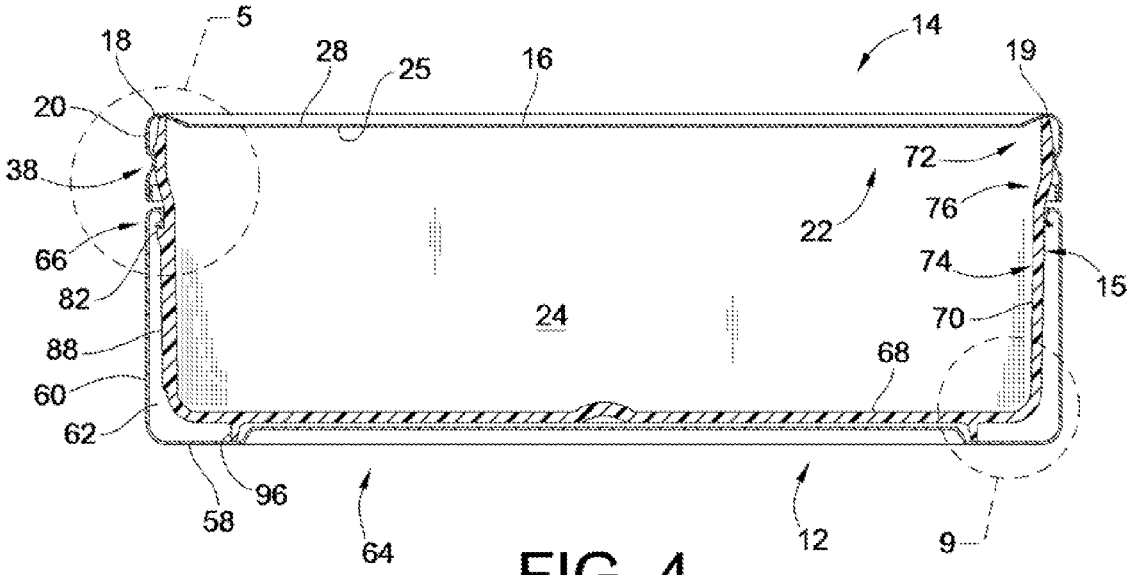
FIG. 4 is a cross-sectional illustration of the tobacco can of FIG. 3 taken about cut line 4-4.

With reference to FIG. 4, in the illustrated embodiment, the lid 14 is formed from a relatively thin piece of metal (e.g., sheet metal). As shown, the lid 14 includes a circular lid top 16 and a skirt in the form of a cylindrical side wall 20 that extends from the lid top 16. The juncture of the skirt and the lid top 16 forms a shoulder 18 that may provide an upper annular recessed pocket for receiving a distal upper end 19 of the liner 15 In the illustrated embodiment, the lid 14 is a unitary body formed by lid top 16, shoulder 18, and sidewall 20. The lid top 16 and sidewall 20 generally define a cavity 22 of the lid 14 that receives an top portion of liner 15. As shown in FIG. 4, when the lid 14 is positioned or seated upon the top portion of liner 15, an enclosed storage cavity 24 is defined within the container 10. The storage cavity 24 is where the product is stored until removed by the consumer.

In one embodiment, the upper end 19 of the liner 15 engages the inner surface 25 of lid 14 and provides a seal therebetween to assist in maintaining the freshness of the products stored in the container 10. In a preferred embodiment, inner surfaces of the lid 14 are coated with a gold phenolic finish. Even so, in other embodiments other types of coatings or finishes may be applied to, or formed on, these interior surfaces.

Figure 3:
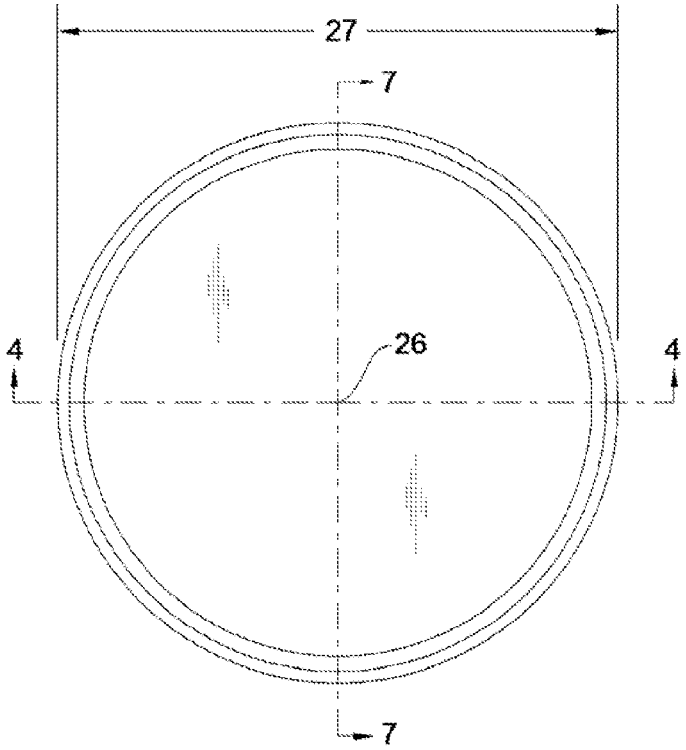
FIG. 3 is a top plan view of the tobacco can of FIG. 1.

As depicted in FIG. 3, The lid top 16 generally extends radially outwardly from center point 26 between about one inch and about one and half inches. Therefore, the lid 14 has a diameter 27 of between about two inches and about three inches. In the illustrated embodiment, the diameter 27 of the lid 14 is about 2.5 inches.

Referring back to FIG. 4, the lid top 16 includes both an inner and outer surface 25, 28 (i.e., exterior and interior surface) facing in opposing directions. As the lid is formed from sheet metal, the inner and outer surfaces 25, 28 are parallel to each other. Although not shown, the lid top 16 may include embossed letters, numbers, images, and the like (collectively "characters"). The embossed characters may project upwardly away from the container body 12 or fall downwardly into the storage cavity 24. In that regard, the embossed characters either have a height or depth of about 0.015 of an inch or less.

Sidewall 20 extends circumferentially around lid top 16 and downward generally perpendicularly from lid top 16.

Figure 5:
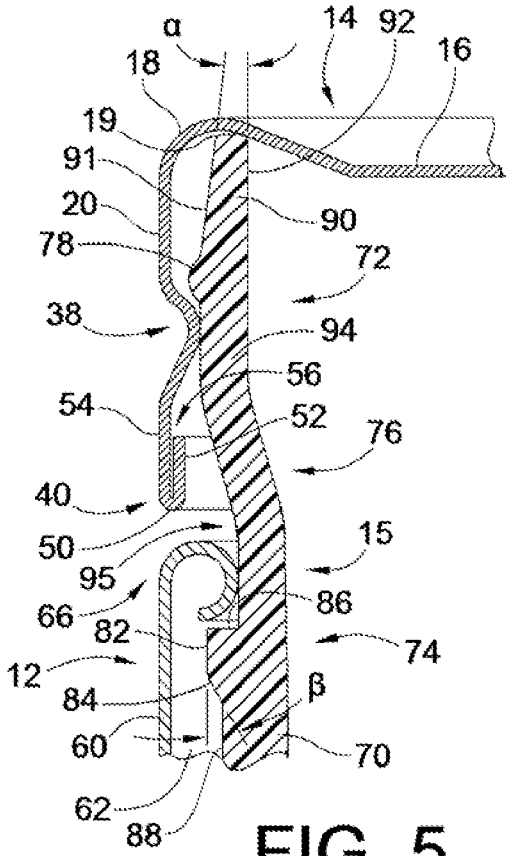
FIG. 5 is an enlarged partial illustration of the cross-sectional illustration of FIG. 4 illustrating the engagement of the cover with the liner.

With further reference to FIG. 5, Sidewall 20 includes both a bead 38 and a hem 40. The bead 38 is generally interposed between the hem 40 and shoulder 18. The bead 38 projects radially inward toward the center point 26 of the lid top 16. While the illustrated embodiment includes both a hem 40 and a bead 38, alternative embodiments need not include these structures.

The bead 38 progresses circumferentially and continuously around the entire side wall 20 of the lid 14. Therefore, as the bead 38 extends around the lid 14, the bead is unbroken and uninterrupted. Even so, in another embodiment the bead 38 may be intermittently formed such that the side wall 20 is, at discrete locations, planar all the way from shoulder 18 to just above a bottom 50 of the hem 40. In such embodiments, a thin column or portion of the side wall 20 is not bowed inwardly and instead appears flat when viewed from outside the container 10.

The hem 40 is generally a distal portion 52 of the side wall 20 folded inwardly adjacent an intermediate portion 54 of the side wall. In other words, the distal portion 52 is curled inwardly toward the lid top 16 to be in contact or almost contact with the inner surface of the remainder of the side wall 20. In the illustrated embodiment, the distal portion 52 and the intermediate portion 54 are illustrated slightly spaced apart from each other to form channel 56 between the two portions of the side wall. In the illustrated embodiment, because the hem 40 is a folded piece of metal, the hem generally need not be smoothed, ground, buffed, or otherwise machined to eliminate the terminating cut edge. The hem 40 naturally possesses a bottom 50 that is rounded and smooth. By creating a safety edge at the bottom 50 of the lid 14 through folding instead of otherwise machining as noted above, the lid may be more quickly, easily, and cost-effectively fabricated.

More features and aspects of the lid 14 can be found in co-pending U.S. patent application Ser. No. 11/680,333, entitled "Lid For A Tobacco Can" filed on Feb. 28, 2007 and assigned to the assignee of the instant application, the teachings and disclosures of which are hereby incorporated herein by reference thereto.

Referring to FIGS. 4 and 5, in the illustrated embodiment, the container body 12 is formed from a relatively thin piece of metal (e.g., sheet metal). As shown, the container body 12 includes a circular bottom 58 and an annular sidewall 60 that extends from and circumferentially surrounds the circular bottom 58. In the illustrated embodiment, the container body 12 is a unitary body formed by circular bottom 58 and sidewall 60. The circular bottom 58 and sidewall 60 generally define a cavity 62 of the container body 12 that receives a bottom portion of liner 15.

The circular bottom 58 of the container body 12 includes a recessed portion 64 that is positioned radially inward from sidewall 60.

A rolled over portion 66 forms a distal end of sidewall 60. The rolled over portion 66 is formed from the distal portion of sidewall 60 opposite the circular bottom 58. The rolled over portion 66 is rolled radially inwardly and typically has a diameter of between about 0.025 and 0.065 inch and most preferably about 0.05 inch.

Figure 6:
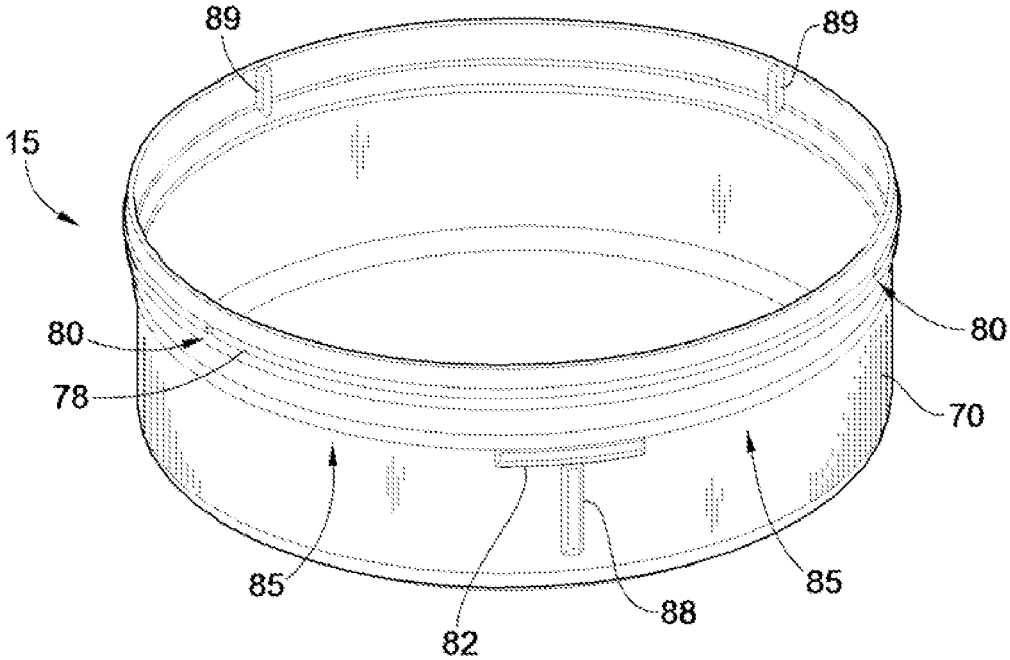
FIG. 6 is a top and front perspective view of the liner of the tobacco can of FIG. 1.

Referring to FIGS. 4-6, liner 15 includes a circular bottom 68 and an annular sidewall 70 that extends from and circumferentially surrounds the circular bottom 68. The sidewall 70 includes a top portion 72, a bottom portion 74 and an intermediate portion 76 therebetween. The top portion 72 is offset radially outward relative to the bottom portion 74 by tapered intermediate portion 76 such that the outer surface of bottom portion 74 is radially recessed inward relative to the radially outer surface of top portion 72.

The top portion 72 is received by lid 14 and more particularly in cavity 22. The bottom portion 74 is received by container body 12 and more particularly in cavity 62.

The top portion 72 includes a radially outward extending rib 78 (a.k.a., bead lock) that extends around sidewall 70. In one embodiment, rib 78 is intermittently formed such that top portion 72 is, at discrete locations, planar all the way from shoulder 18 to intermediate portion 76 to distal upper end 19. Thus, the rib 78 has a plurality of segments that are angularly spaced apart forming gaps 80 therebetween. These gaps 80 assist in venting air from the lid 14 as the lid 14 is secured to the liner 15. Even so, in another embodiment, the rib 78 may be unbroken and uninterrupted.

The bottom portion 74 includes a plurality of projections 82 extending angularly about the center point 26 of the container 10. The illustrated embodiment includes three such projections 82 angularly spaced about center point 26 forming gaps 85 therebetween. Even so, in another embodiment, the plurality of projections 82 may be replaced by a single continuous projection that extends around sidewall 70 unbroken and uninterrupted.

The projections 82 include a bottom surface 84 that extends at an angle β of between 15 degrees and 45 degrees and is preferably about 30 degrees. The projections also include a catch surface 86 facing axially away from circular bottom 68. The catch surface 86 axially engages the rolled over portion 66 of container body 12 to secure the container body 12 to the liner 15. Preferably, the catch surface 86 is generally perpendicular to sidewall 70 and is generally planar. The catch surface 86 typically extends between about 0.01 and 0.04 inches from the outer surface of the bottom portion 74 of sidewall 70, but preferably extends between about 0.02 and 0.03 inches from the outer surface of the bottom portion 74.

Further yet, bottom portion 74 can optionally include one or more axially extending ribs 88 that assist in spacing the container body 12 from the outer surface of sidewall 70 so as to provide a vent for expelling air as the liner 15 is inserted into cavity 62 of the container body 12.

Figure 13:
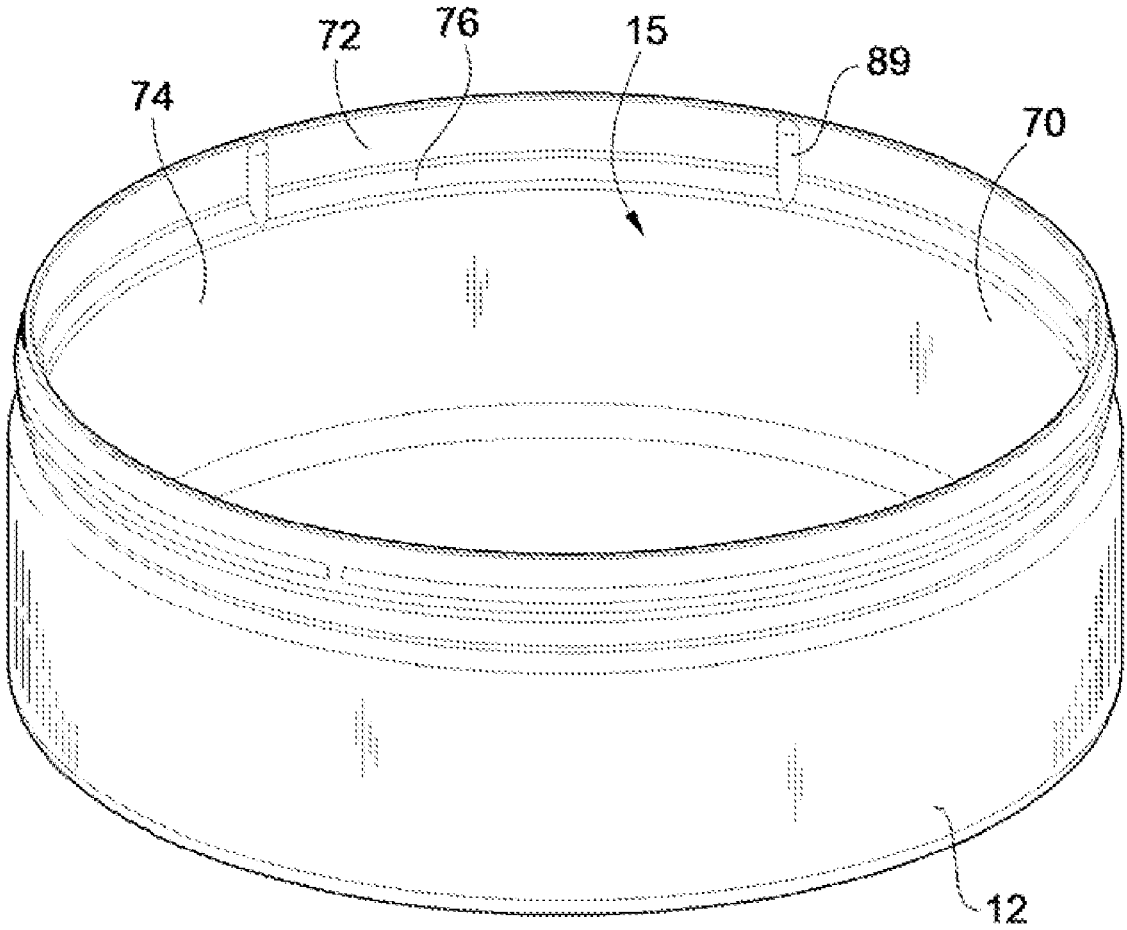
FIG. 13 is a perspective illustration of the container body coupled to the container liner of FIG. 9.

With reference to FIGS. 6 and 13, the inner surface of the liner 15 further includes anti-nesting projections 89 that extend radially inward from the top portion 72 and intermediate portion 76 of sidewall 70. The anti-nesting projections 89 extend radially inward to prevent nesting of two liners in the event that two or more liners are set on-top of one another, such as during storage or transportation.

The liner 15 secures the lid 14 to the container body 12 without the container body 12 needing to directly contact the lid 14.

Rolled over portion 66 and the plurality of projections 82 provide a first cooperating catch arrangement for securing the container body 12 to the bottom portion 74 of liner 15. The rolled over portion 66 axially engages the catch surfaces 86 of the plurality of projections 82 to prevent or oppose axial removal of the liner 15 from container body 12.

Similarly, bead 38 and rib 78 provide a second cooperating catch arrangement for securing lid 14 to the top portion 72 of liner 15. The bead 38 axially engages the rib 78 to prevent or oppose axial removal of the lid 14 from liner 15.

Preferably, the engagement between bead 38 and rib 78 provides for releasable securement of lid 14 to liner 15 such that the lid 14 can be repeatably secured to and removed from liner 15. This allows the consumer to open the container 10 to remove product therefrom as desired and then to close the container 10 to secure the contents therein when finished accessing the product.

Additionally, the securement between the lid 14 and liner 15 can be overcome by a lower axial loading than the securement between the container body 12 and liner 15. As such, when a consumer is holding the container 10 by the container body 12, the consumer can remove the lid 14 by axially pulling on the lid 14 without the container body 12 being removed from the liner 15.

Top portion 72 of sidewall 70 includes several segments. A tapered segment 90 extends axially between upper end 19 and rib 78. The tapered segment 90 has an outer surface 91 that is tapered at an angle α that is between about 5 degrees and 15 degrees, but is preferably about 7 to 8 degrees, relative to inner surface 92. Inner surface 92 is preferably generally parallel to an axis running orthogonal between the lid top 16 and the circular bottom 68. The tapered configuration of tapered segment 90 assists in mounting the lid 14 to the liner 15. However, in other embodiments, the tapered segment need not be included.

An extension segment 94 extends axially between the end of the intermediate portion 76 of sidewall 70 and the bottom of rib 78. The extension segment 94, in one embodiment has a constant thickness. In an alternative embodiment, the extension segment 94 and the tapered segment 90 are merely a continuous tapered portion of sidewall 70 that merely includes a rib 78 that separates the portion into different portions.

The inclusion of intermediate portion 76 offsets the top portion 72 radially from the bottom portion 74. The intermediate portion 76 and projections 82 define relief zones 95 axially therebetween for receiving the rolled over portion 66 when the lid 14 is mounted to the liner 15.

The container body 12 preferably engages the liner 15 such that limited to no axial slop is provided therebetween. More particularly, the liner 15 preferably cannot move axially relative to the container body 12 when the container 10 is fully assembled.

Figure 7:
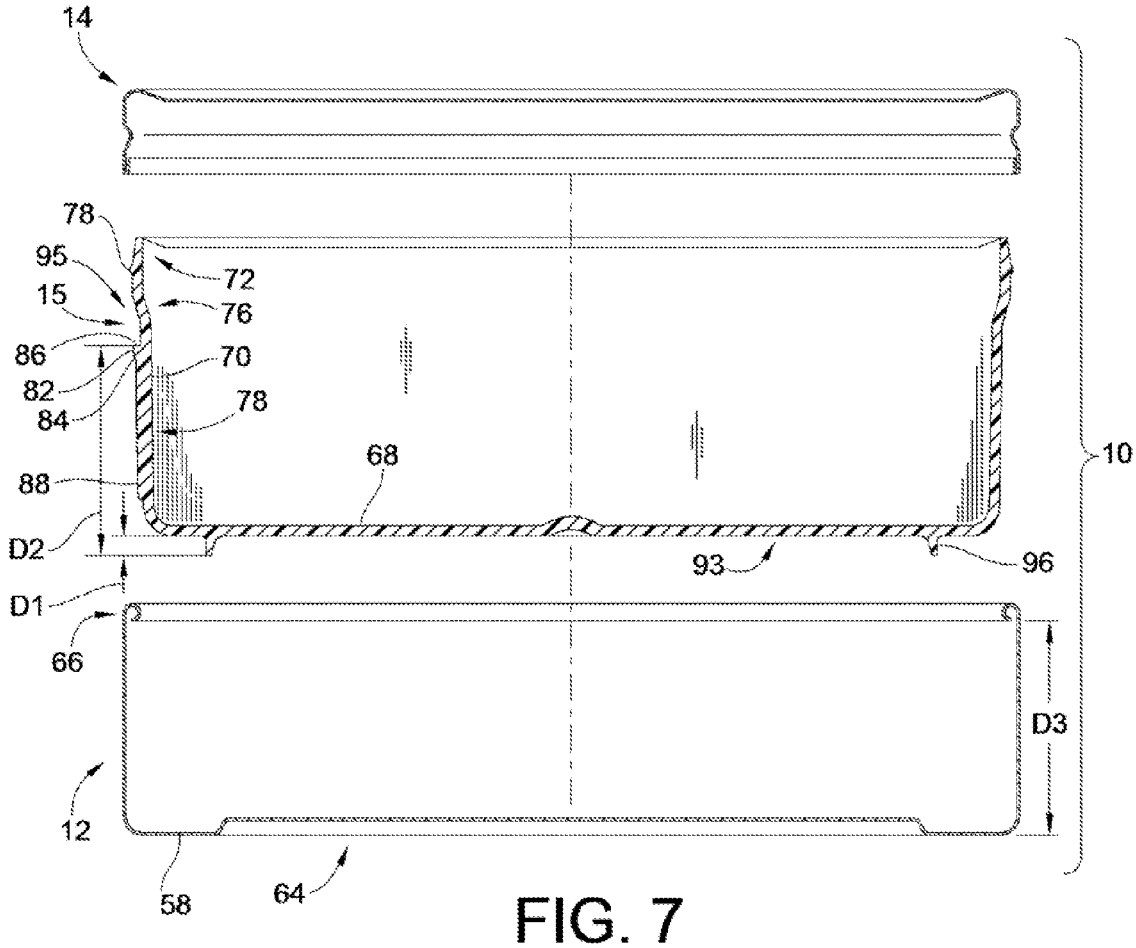
FIG. 7 is an exploded cross-sectional illustration of the tobacco can of FIG. 3 about cut line 7-7.
Figure 8:
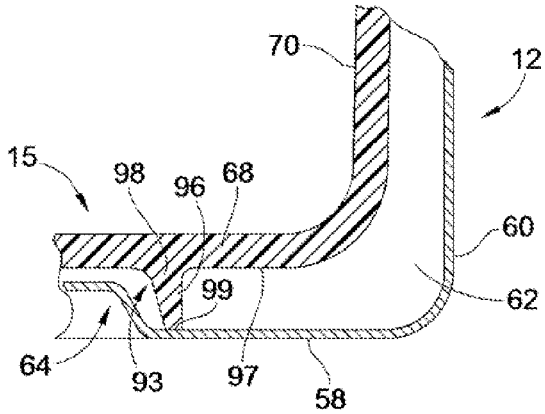
FIG. 8 is an enlarged partial illustration of the cross-sectional illustration of FIG. 4 illustrating the interaction of the container body with the liner.
Figure 9:
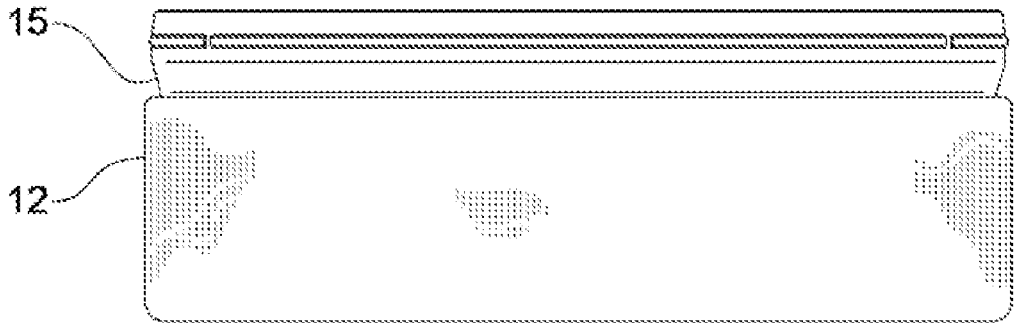
FIG. 9 is a profile illustration of the container body coupled to the container liner, this view being identical to the front, back and other side views.
Figure 10:
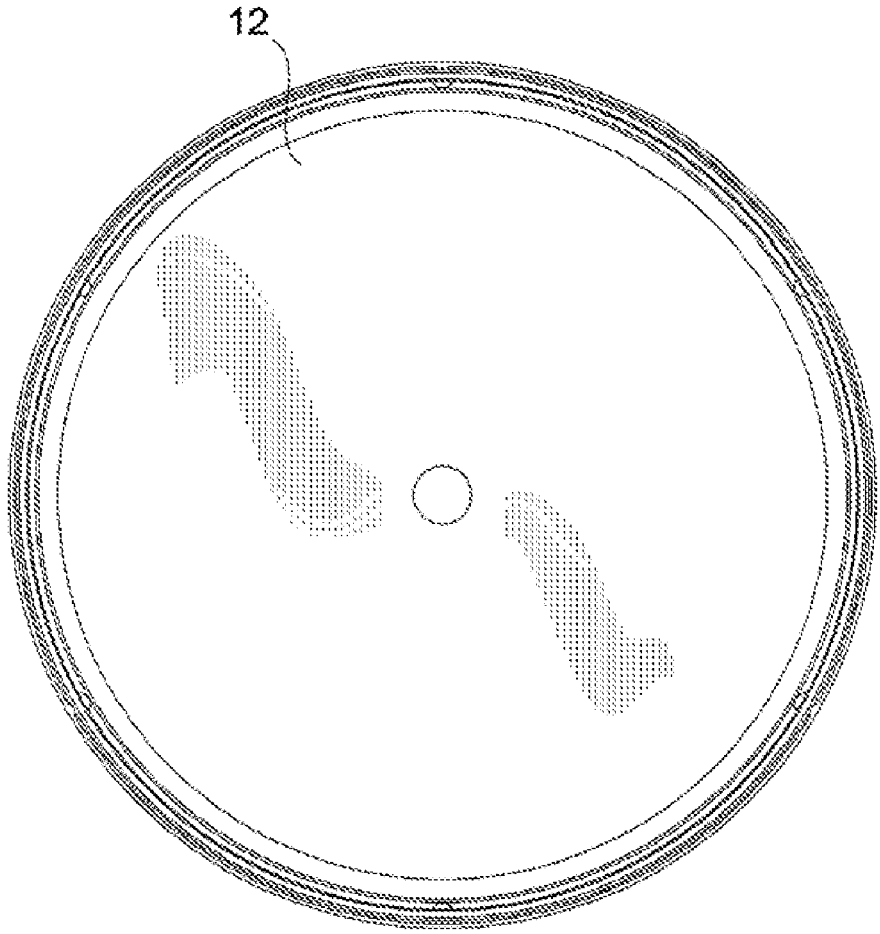
FIG. 10 is a top view illustration of the container body coupled to the container liner of FIG. 9.
Figure 11:
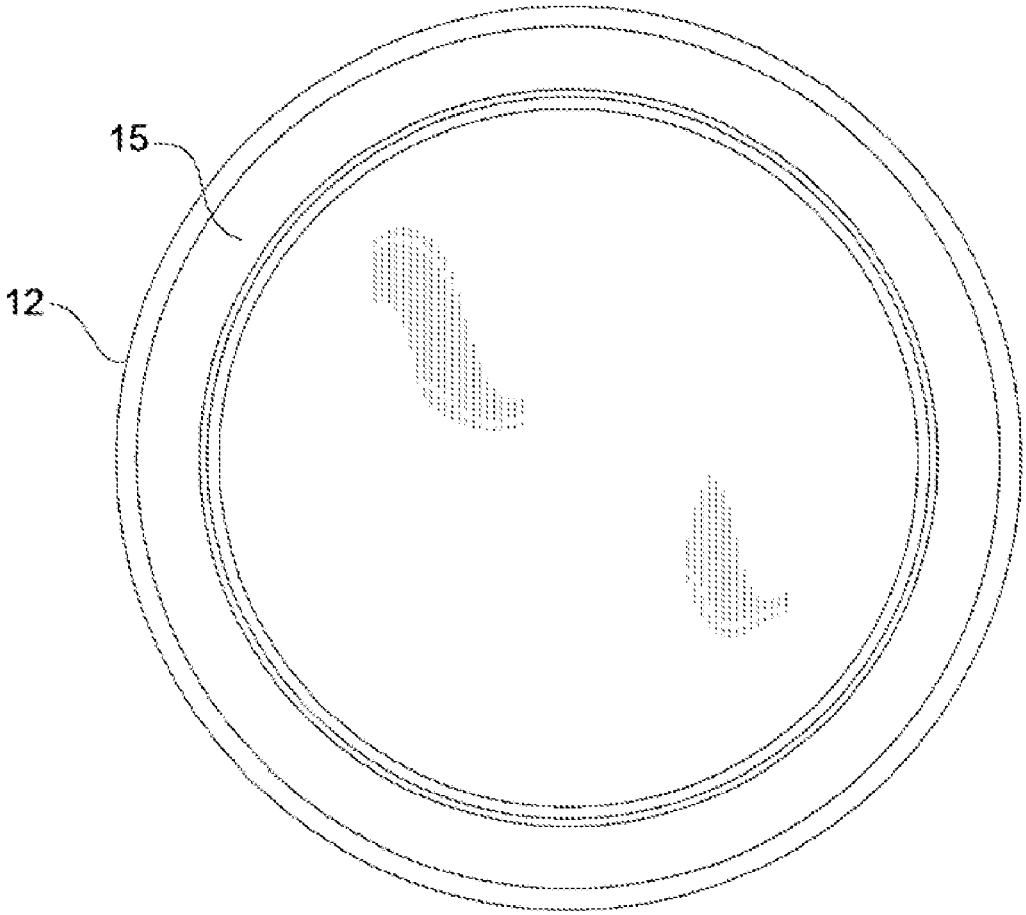
FIG. 11 is a bottom view illustration of the container body, which is the same illustration when the container body is coupled to the container liner and/or the container lid.
Figure 12:
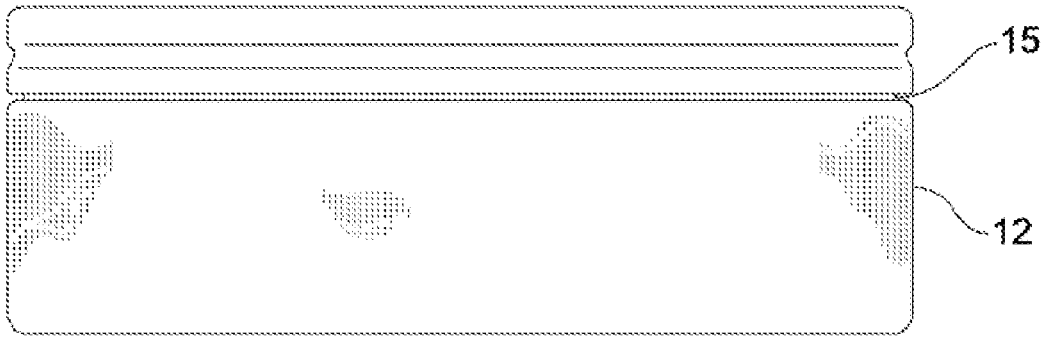
FIG. 12 is a profile illustration of the container body coupled to the container liner and container lid, this view being identical to the front, back and other side views.

With reference to FIGS. 7 and 8, in one embodiment, the liner 15 includes a compression lip 96 that extends axially from an outer surface 97 of circular bottom 68. The compression lip 96 forms a void 93 (a.k.a., cavity) that in which the recessed portion 64 of circular bottom 58 of the container body 12 axially extends.

The compression lip 96 of the illustrated embodiment is a plurality of segments that form an annular hub. However, the gaps between adjacent segments of the compression lip provide venting for permitting air to escape as the liner 15 and container body 12 are secured together. However, in other embodiments the compression lip could be formed from a continuous uninterrupted segment. Further yet, the compression lip need not be circular in shape and could merely be a plurality of axially extending nibs or projections that contact the bottom wall 58 of container body 12.

As illustrated, the compression lip 96 extends axially from the outer surface 97 of the circular bottom 68 a distance D1 of between about 0.04 inch to about 0.1 inch, however, other lengths could be incorporated. Further, the compression lip 96 preferably tapers as it extends away from circular bottom 68 from a wider base portion 98 to a narrower tip 99. The taper promotes more consistent flexure of the compression lip 96 and the rigidity of the compression lip 96 increases the more the compression lip is flexed.

When the container body 12 is connected to the liner 15, the compression lip 96 is preferably biased against the inner surface of circular bottom 58 and, at least, resiliently deformed. By resiliently deforming compression lip 96, the catch surfaces 86 of projections 82 are biased into rolled over portion 66 of the container body 12. In one embodiment, the amount of biasing provided by the compression lip 96 and engagement between the rolled over portion 66 and sidewall 70 of the liner 15 is sufficient to prevent rotation of the liner 15 relative to the container body 12. It is meant by "to prevent rotation", to mean that more than mere simple rotation by a user of the liner 15 relative to the container body 12 is required to cause relative rotation between the two components, such as for example more than 2 inch-lbs of torque.

With reference to FIG. 7, in an unassembled state, the axial distance D2 between the catch surfaces 86 of projections 82 and the distal end of the compression lip 96 is greater than the axial distance D3 between the portion of the rolled over portion 66 axially closest the circular bottom 58 and the portion of the bottom wall 58 upon which the compression lip 96 is biased.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A tobacco container comprising:

a lid;

a container body;

a liner releasably connecting the lid to the container body, each of the lid and container body receiving the liner and connecting to the liner;

wherein:

the liner is cup-shaped including a first bottom wall and an annular first sidewall extending from a first side of the first bottom wall forming a first cavity;

the container body is cup-shaped including a second bottom wall and an annular second sidewall extending from the second bottom wall forming a second cavity, the second cavity receiving the first bottom wall and a bottom portion of the first sidewall of the liner;

the lid is cup-shaped including a top wall and an annular third sidewall extending from the top wall forming a third cavity, the third cavity receiving a top portion of the first sidewall of the liner; and a compression lip extending from a second opposite side of the first bottom wall, the compression lip axially biased against a portion of an inner surface of the second bottom wall and deformed when the liner is connected to the container body.

2. The tobacco container of claim 1, wherein the compression lip is generally circular such that it circumscribes a central axis passing through a center point of the tobacco container and is formed by a plurality of angularly spaced lip segments.

3. The tobacco container of claim 1, wherein the second bottom wall includes a recessed region radially inward from the second sidewall and the compression lip is generally circular defining a void, the recess region axially extending into the void.

4. The tobacco container of claim 1, wherein a connection between the liner and the container body is axially greater than a connection between the liner and the lid such that axial removal of the lid from the liner while grasping the container body does not disconnect the container body from the liner.

5. The tobacco container of claim 1, wherein the first sidewall includes a radially outward extending catch and the second sidewall has a radially inward extending catch connecting the container body to the liner, wherein a spring force within the compression lip due to the compression lip being axially biased against the bottom wall axially biases the radially outward extending catch into axial engagement with the radially inward extending catch.

6. The tobacco container of claim 5, wherein the radially outward extending catch is at least one radially extending projection formed by a radially outer surface of the first sidewall and the radially inward extending catch is an end portion of the second sidewall that is deformed to extend radially inward from the rest of the second sidewall.

7. The tobacco container of claim 1, wherein the liner is formed of a plastic material and the lid and container body are formed of sheet metal.

8. The tobacco container of claim 1, wherein the annular first sidewall provides a radially extending catch surface, the second annular sidewall provides a radially extending catch portion, wherein the axial distance between a distal end of the compression lip and the catch surface of the annular first sidewall in an unassembled state is greater than the axial distance between the catch portion of the second annular sidewall the inner surface of the second bottom wall upon which the compression lip is axially biased.

9. The tobacco container of claim 1, wherein the compression lip is an annular wall having a radially inner surface and a radially outer surface defining a thickness between, wherein the thickness of the annular wall tapers as the annular wall extends away from the second opposite side of the first bottom wall from a wider base portion to a narrower distal end.

10. A tobacco container comprising:

a lid;

a container body;

a liner releasably connecting the lid to the container body, each of the lid and container body receiving the liner and connecting to the liner;

wherein:

the liner is cup-shaped including a first bottom wall and an annular first sidewall extending from a first side of the first bottom wall forming a first cavity;

the container body is cup-shaped including a second bottom wall and an annular second sidewall extending from the second bottom wall forming a second cavity, the second cavity receiving the first bottom wall and a bottom portion of the first sidewall of the liner; and the lid is cup-shaped including a top wall and an annular third sidewall extending from the top wall forming a third cavity, the third cavity receiving a top portion of the first sidewall of the liner;

wherein the liner is formed of a plastic material and the lid and container body are formed of metal;

wherein the first and second sidewalls have a first cooperating catch arrangement for connecting the container body to the liner and the first and third sidewalls having a second cooperating catch arrangement for releasably connecting the lid to the liner; and wherein a connection between the liner and the container body provided by the first cooperating catch arrangement is axially greater than a connection between the liner and the lid provided by the second cooperating catch arrangement such that axial removal of the lid from the liner while grasping the container body does not disconnect the container body from the liner; and wherein:

the first cooperating catch arrangement includes at least one radially outward extending projection formed on an outer surface of the lower portion of the first sidewall and a radially inward folded over end portion of the second sidewall; and the second cooperating catch arrangement includes a radially inward extending bead formed in the third sidewall and a radially outward extending projection of an outer surface of the top portion of the first sidewall and the second cooperating catch arrangement;

wherein the metal is sheet metal.

11. The tobacco container of claim 10, wherein the liner is a self supporting structure such that it will hold its shape independent of the lid and container body.

12. The tobacco container of claim 10, wherein a radially outer surface of the top portion extends radially outward beyond a radially outer surface of the bottom portion.

13. The tobacco container of claim 10, wherein the lid is axially spaced from the container body forming a gap thereinbetween when the lid is secured to the liner.

14. The tobacco container of claim 10, wherein a distal end of the first sidewall directly contacts an inner surface of the top wall when the lid is secured to the liner.

15. The tobacco container of claim 14, wherein the distal end and the inner surface of the top wall form a seal when the lid is connected to the liner.

16. The tobacco container of claim 10, wherein the at least one radially outward extending projection of the first cooperating catch arrangement includes a plurality of radially outward extending projections angularly spaced apart forming angular gaps thereinbetween, the radially outward extending projections of the first cooperating catch arrangement extending angularly about a center of the liner parallel to a distal upper end of the first sidewall, the radially outward extending projections of the first cooperating catch arrangement are each located at a same axial distance from the distal upper end of the first sidewall, the distal upper end of the first sidewall being at an opposite end of the first sidewall as the first bottom wall.

17. The tobacco container of claim 10, further including at least one rib extending radially outward from an outer surface of the bottom portion of the first sidewall, the rib separating at least part of the first sidewall from a corresponding part of the second sidewall.

18. The tobacco container of claim 10, wherein the lid does not contact the container body when the lid is connected to the liner and the container is in a quiescent state.

19. The tobacco container of claim 10, wherein the second cooperating catch arrangement provides a snap-fit engagement between the lid and the liner that allows axially pulling the lid from the liner.

20. The tobacco container of claim 10, wherein the lid and container body receive the liner such that an outer periphery of the liner is substantially entirely surrounded by the lid and container body and such that an outer periphery of the tobacco container is substantially defined by the lid and container body.

21. The tobacco container of claim 10, wherein the lid and container body receive the liner in the second, and third cavities such that the liner is substantially entirely housed within second and third cavities and a first portion of the volume defined by the first cavity is directly within the second cavity and a second portion of the volume defined by the first cavity is directly within the third cavity.

22. The tobacco container of claim 10, wherein lid and container bottom substantially define an outer periphery of the tobacco container and the liner is entirely contained internal to the outer periphery.

23. The tobacco container of claim 10, wherein the top wall and the second bottom wall are each continuous having no openings therein.

24. The tobacco container of claim 10, wherein the first annular sidewall defines an open end, the first and second cooperating catch arrangements are positioned closer to the open end than the first bottom wall.

25. The tobacco container of claim 10, wherein the annular first sidewall of the liner extends only on the first side of the first bottom wall and the annular first sidewall transitions into the first bottom wall, and wherein the annular first sidewall does not extend on an opposite second side of the first bottom wall.

26. A tobacco container comprising:

a lid;

a container body;

a liner releasably connecting the lid to the container body, each of the lid and container body receiving the liner and connecting to the liner;

wherein;

the liner is cup-shaped including a first bottom wall and an annular first sidewall extending from a first side of the first bottom wall forming a first cavity;

the container body is cup-shaped including a second bottom wall and an annular second sidewall extending from the second bottom wall forming a second cavity, the second cavity receiving the first bottom wall and a bottom portion of the first sidewall of the liner;

the lid is cup-shaped including a top wall and an annular third sidewall extending from the top wall forming a third cavity, the third cavity receiving a top portion of the first sidewall of the liner; and wherein the first and second sidewalls have a first cooperating catch arrangement for cooperating catch arrangement for releasably connecting the lid to the liner;

wherein a connection between the liner and the container body provided by the first cooperating catch arrangement is axially greater than a connection between the liner and the lid provided by the second cooperating catch arrangement such that axial removal of the lid from the liner while grasping the container body does not disconnect the container body from the liner; and wherein the first cooperating catch arrangement extends angularly relative to a central axis of the container along, at least, a portion of the circumference of the first sidewall, the first cooperating catch arrangement is a constant axial distance from a distal upper end of the first sidewall at all angular locations of the first cooperating catch arrangement, and the second cooperating catch arrangement extends angularly relative to a central axis of the container along, at least, a portion of the circumference of the first sidewall, the second cooperating catch arrangement is a constant axial distance from the distal upper end of the first sidewall at all angular locations of the second cooperating catch arrangement;

wherein the liner is formed of a plastic material and the lid and container body are formed of sheet metal.

* * * * *

UNITED STATES PATENT AND TRADEMARK OFFICE

CERTIFICATE OF CORRECTION

PATENT NO. : 8,215,482 B2
APPLICATION NO. : 12/168244
DATED : July 10, 2012
INVENTOR(S) : Edward P. Cronin et al.

It is certified that error appears in the above-identified patent and that said Letters Patent is hereby corrected as shown below:

In column 10, line 8, "second," should be -- second -- .

In column 10, lines 51 and 52, "catch arrangement for cooperating catch arrangement" should be -- catch arrangement for connecting the container body to the liner and the first and third sidewalls having a second cooperating catch arrangement --.

Signed and Sealed this
Eleventh Day of September, 2012

David J. Kappos

David J. Kappos
*Director of the United States Patent and Trademark Office*